US007588383B2

(12) United States Patent
Hokimoto et al.

(10) Patent No.: US 7,588,383 B2
(45) Date of Patent: Sep. 15, 2009

(54) MECHANICAL PENCIL

(75) Inventors: Shunsuke Hokimoto, Hirakata (JP); Nobuaki Kobayashi, Nara (JP)

(73) Assignee: Sakura Color Products Corporation (JP)

( * ) Notice: Subject to any disclaimer, the term of this patent is extended or adjusted under 35 U.S.C. 154(b) by 14 days.

(21) Appl. No.: 11/920,199

(22) PCT Filed: May 11, 2006

(86) PCT No.: PCT/JP2006/309481

§ 371 (c)(1),
(2), (4) Date: Nov. 9, 2007

(87) PCT Pub. No.: WO2006/121116

PCT Pub. Date: Nov. 16, 2006

(65) Prior Publication Data

US 2009/0028626 A1 Jan. 29, 2009

(30) Foreign Application Priority Data

May 12, 2005 (JP) ..... 2005-139891

(51) Int. Cl.
*B43K 21/22* (2006.01)

(52) U.S. Cl. ..... 401/93; 401/92

(58) Field of Classification Search ..... 401/92–94
See application file for complete search history.

(56) References Cited

U.S. PATENT DOCUMENTS 6,379,067 B2 * 4/2002 Kageyama et al. ..... 401/94

* cited by examiner

*Primary Examiner*—David J Walczak
(74) *Attorney, Agent, or Firm*—Wood, Phillips, Katz, Clark & Mortimer

(57) ABSTRACT

A mechanical pencil includes an advancing mechanism and a slider both incorporated in a main body. The advancing mechanism has a chuck and a chuck ring (collar for fastening the chuck) for holding a lead, so as to advance the lead. The slider is slidable relative to the main body and has a lead guide and a lead friction member. The lead friction member is to friction with the lead and is made of thermoplastic elastomer.

16 Claims, 8 Drawing Sheets

MECHANICAL PENCIL

BACKGROUND OF THE INVENTION

1. Field of the Invention

The present invention relates to a mechanical pencil provided with a slider.

2. Background Art

Mechanical pencils adapted to advance a lead by a knocking operation are conventionally used. In using such mechanical pencils, a lead is advanced and exposed from its distal end by an appropriate length and the lead is further advanced by a knocking operation when the lead has become short by the use.

The known mechanical pencils are disclosed in the patent documents 1 and 2, the mechanical pencils each being provided with a slider having a lead guide at a distal end of the mechanical pencil, which guide is forced to slide to feed the lead in response to a remaining length of the lead so as to keep on being used.

Such mechanical pencils as disclosed in the patent documents each arrange the slider within a head section thereof. The slider is movable back and forth and includes an inner friction part to friction with a lead and an outer friction part to friction with an inner surface of the head section.

A tubular lead guide is fixed to a distal end of the slider and communicates with the inner friction part of the slider. In advancement of a lead toward the distal end by a knocking operation, the slider moves toward a distal side from a proximal side due to a frictional resistance between the lead and the inner friction part of the slider. In writing, the lead guide appropriately moves in response to a remaining length of the lead, so as to expose the lead by an appropriate length.

A chuck having a chuck portion is moved forward and backward with a collar (also called "a chuck ring") for fastening the chuck by a knocking operation. The collar is disengaged from the chuck at a position during forwardly moving and the lead is advanced to the position. When the chuck portion is moved backward, the frictional resistance of the slider prevents the lead from being retracted with the collar disengaged, so that the lead is advanced by a predetermined length.

Patent document 1: JP 3-47907 Y

Patent document 2: JP 2560818 Y

DISCLOSURE OF THE INVENTION

Problems to be Solved by the Invention

Mechanical pencils having such a slider need to make a frictional resistance between the inner friction part and a lead within an appropriate range.

Too small frictional resistance at the inner friction part might result in an insufficient advancement of a lead because of slip of the lead at the inner friction part that causes retraction of the lead in taking back of a knocking operation.

On the other hand, the frictional resistance at the inner friction part cannot be made too large because of the following reason.

The chuck portion holds a lead just before completion of taking back of a knocking operation, thereby slightly retracting the lead. At this time, it is desired not to move the slider with retraction of the lead. That is why the frictional resistance at the inner friction part of the slider is necessary to be smaller than that at the outer friction part of the slider so as to make the lead to slip at the inner friction part.

Further, in writing, it is necessary to make the lead guide movable appropriately in response to a length of a lead. That is why the frictional resistance at the outer friction part cannot be above a certain level.

Therefore, in order to satisfy the both, it is necessary to make the frictional resistance at the inner friction part smaller than a predetermined value and not more than that value.

In this way, the frictional resistance at the inner friction part should be in a predetermined range. The frictional resistance between the inner friction part and a lead depends on a contacting area, an inner diameter, a material, and so on of the inner friction part. However, variation of an inner diameter caused in manufacturing of a component might be out of the above-mentioned range, resulting in being unable to carry out an assured knocking operation.

Accordingly, it is an object of the present invention to provide a mechanical pencil adapted to carry out an assured knocking operation, dispensing with a complicated structure.

Means to Solve the Problem

A first form of the invention for achieving the object described above is a mechanical pencil including a main body of a tubular shape and having a length direction and a distal end and a proximal end in the length direction, an advancing mechanism arranged within the main body, and a slider arranged within the main body, wherein the advancing mechanism includes a chuck adapted to hold a lead, a collar for fastening the chuck and disposed outside of the chuck, and a biasing member for biasing the chuck toward the proximal end, the chuck being movable in the length direction by a knocking operation in such a manner as being moved forward to an advanced position by an external operation and moved backward to a retracted position by means of the biasing member on condition that the external operation is released with the chuck at the advanced position, the chuck being engaged with the collar so as to hold the lead on condition of being at the retracted position, and being disengaged from the collar so as to release the lead on condition of being at the advanced position, wherein the slider, including a lead guide and a lead friction member, is positioned at a distal side of the chuck so as to be movable in the length direction, the lead friction member being made of thermoplastic elastomer, and wherein the knocking operation renders the chuck to be advanced holding the lead so as to extend the lead to a predetermined position, to release the lead at the position, and to be retracted with maintaining the position of the lead by friction between the lead and the lead friction member, consequently advancing the lead to a distal end of the lead guide.

The first form has an advancing mechanism adapted to render a chuck to be in a holding condition and a releasing condition and a slider being slidable relative to a main body, and is adapted to advance a lead and to make a positional adjustment of a lead guide of the slider. The slider has a lead friction member to contact with a lead, the member being precisely molded because being made of thermoplastic elastomer, thereby reducing variation in manufacturing and reducing fluctuation of knocking operations in using.

A second form of the invention is the mechanical pencil as set forth above, wherein the slider further includes a sliding main body of a tubular shape, into which the lead friction member is inserted.

In the second form, the lead friction member is inserted into a tubular sliding main body, so as to ensure fixation of the lead friction member.

A third form of the invention is the mechanical pencil in any of the forms noted above, the lead friction member having an inner diameter smaller than an outer diameter of a lead to be used.

In the third form, the lead friction member has an inner diameter smaller than an outer diameter of a lead to be used, so as to ensure contact of the member with the lead.

A fourth form of the invention is the mechanical pencil according to any of the above forms, wherein the slider is adapted to move in the length direction maintaining contact with the main body and has an outer friction part in contact with the main body and an inner friction part to be in contact with a lead, the inner friction part being formed on the lead friction member, and the inner and the outer friction parts each having a frictional resistance so that the frictional resistance of the inner friction part is smaller than that of the outer friction part.

In the fourth form, the slider has an outer friction part in contact with the main body and an inner friction part to be in contact with a lead, a frictional resistance of the inner friction part being smaller than that of the outer friction part, thereby stabilizing movement of the slider.

A fifth form of the invention is the mechanical pencil according to any of the above forms, being adapted to push and advance the slider by advancing the chuck.

In the fifth form, the chuck pushes and advances the slider, thereby ensuring advancement of the slider in using.

Advantageous Effect of the Invention

The mechanical pencil using the slider of the present invention enables an assured knocking operation, dispensing with a complicated structure.

DESCRIPTION OF PREFERRED EMBODIMENTS

Figure 1A:
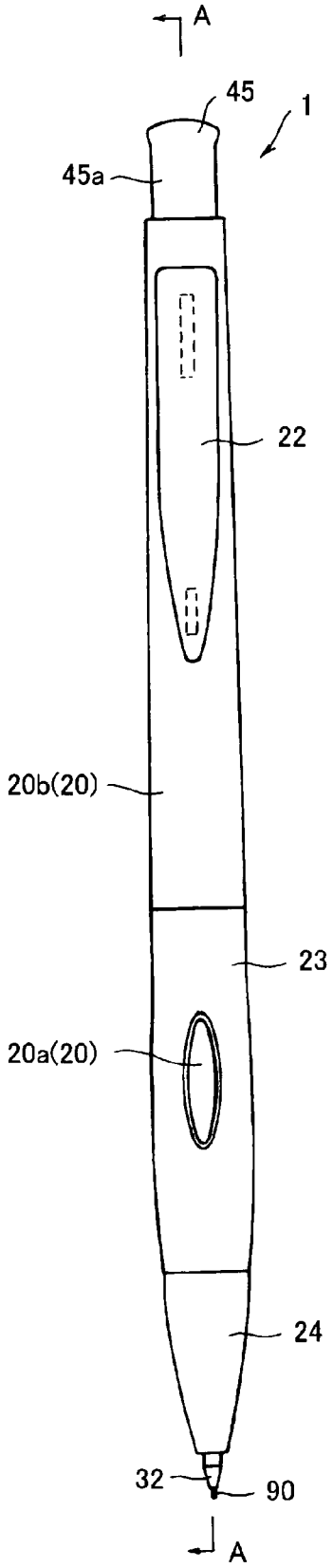
FIGS. 1A and 1B show a mechanical pencil in an embodiment of the present invention, FIG. 1A being a front view thereof, and FIG. 1B being a cross section taken along the line A-A in FIG. 1A.
Figure 1B:
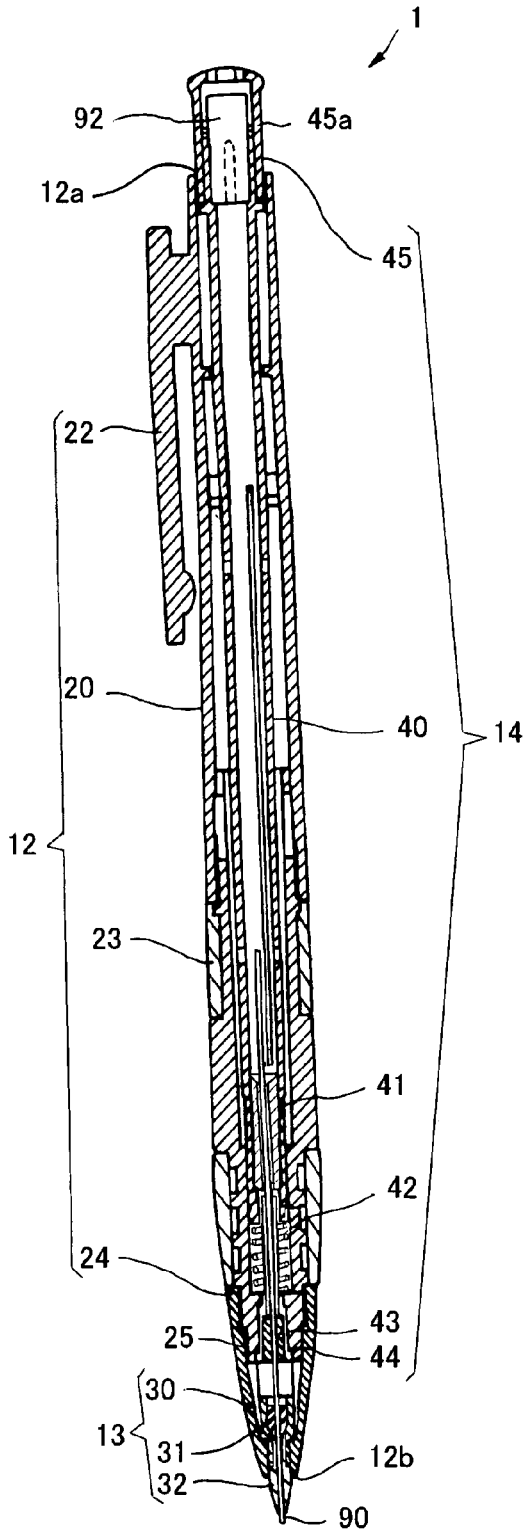

A mechanical pencil 1 of the present invention is shown in FIGS. 1A and 1B and is adapted to advance a lead 90 by a knocking operation and to expose the lead 90 from its distal end, thereby writing down with the exposed lead 90.

Figure 2:
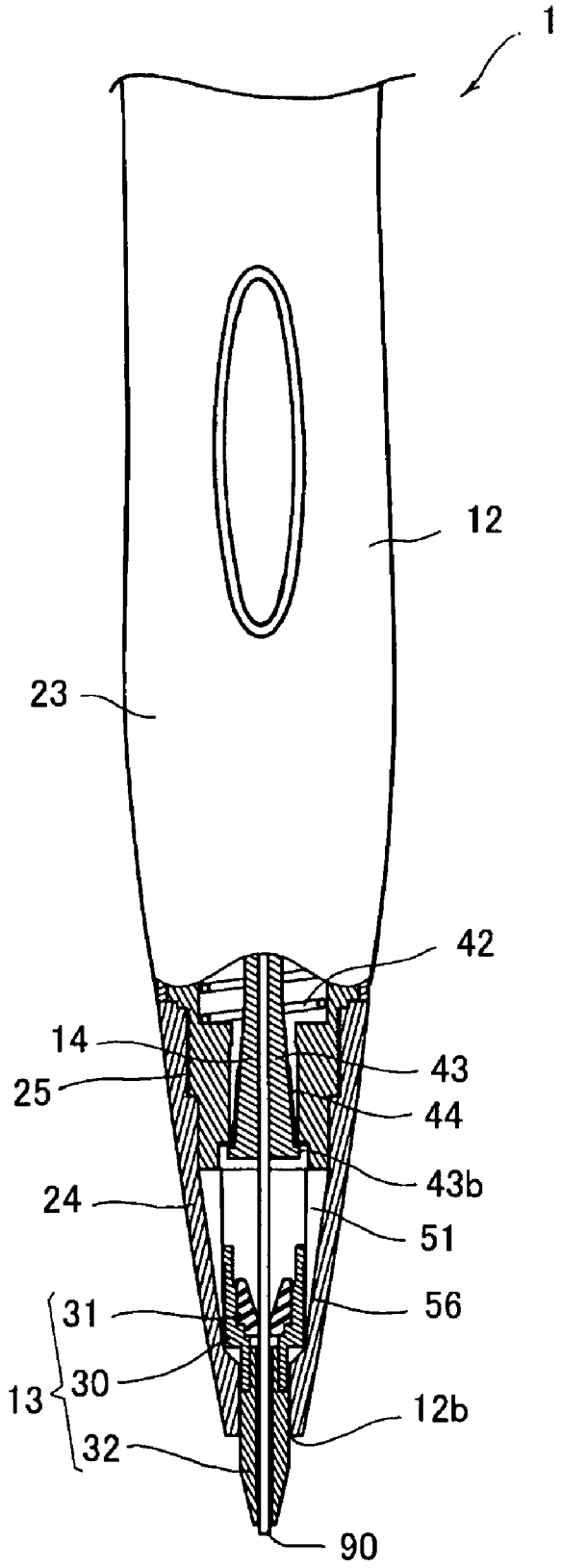
FIG. 2 is a partly-broken cross section on an enlarged scale of a vicinity of a distal end of the mechanical pencil in FIG. 1.

The mechanical pencil 1, as shown in FIGS. 1B and 2, includes a main body 12, a slider 13, and an advancing mechanism 14.

The main body 12 has an outer barrel 20 and an end cone 24. The main body 12 is of a tubular shape as a whole with an opening 12*a* at its proximal end and another opening 12*b* at its distal end. A knocking member 45 of the advancing mechanism 14 is arranged at the opening 12*a*, whereas a lead guide 32 of the slider 13 is arranged at the opening 12*b*.

The outer barrel 20 is of a tubular shape and is a portion to be gripped when writing. Members such as an inner barrel 40 of the advancing mechanism 14 are disposed within the outer barrel 20.

Further, the outer barrel 20 is roughly composed of a front barrel 20*a*, a rear barrel 20*b*, and a grip 23, integrally arranged with a proximal end of the front barrel 20*a* inserted into a distal end of the rear barrel 20*b* and with the grip 23 attached around outside of the front barrel 20*a*.

The rear barrel 20*b* has a clip 22, which is adapted to fix the mechanical pencil 1 to a desired portion such as a pocket by interposing the portion between inside of the clip 22 and the rear barrel 20*b*, so as to protect the mechanical pencil 1 from being lost.

The front barrel 20*a* has at an outer surface of its distal end a threaded portion 25, which is engaged with a threaded portion 50*d* formed on an inner surface of a proximal end of the end cone 24, so that the cone 24 is detachably fixed to the front barrel 20*a*.

Figure 5:
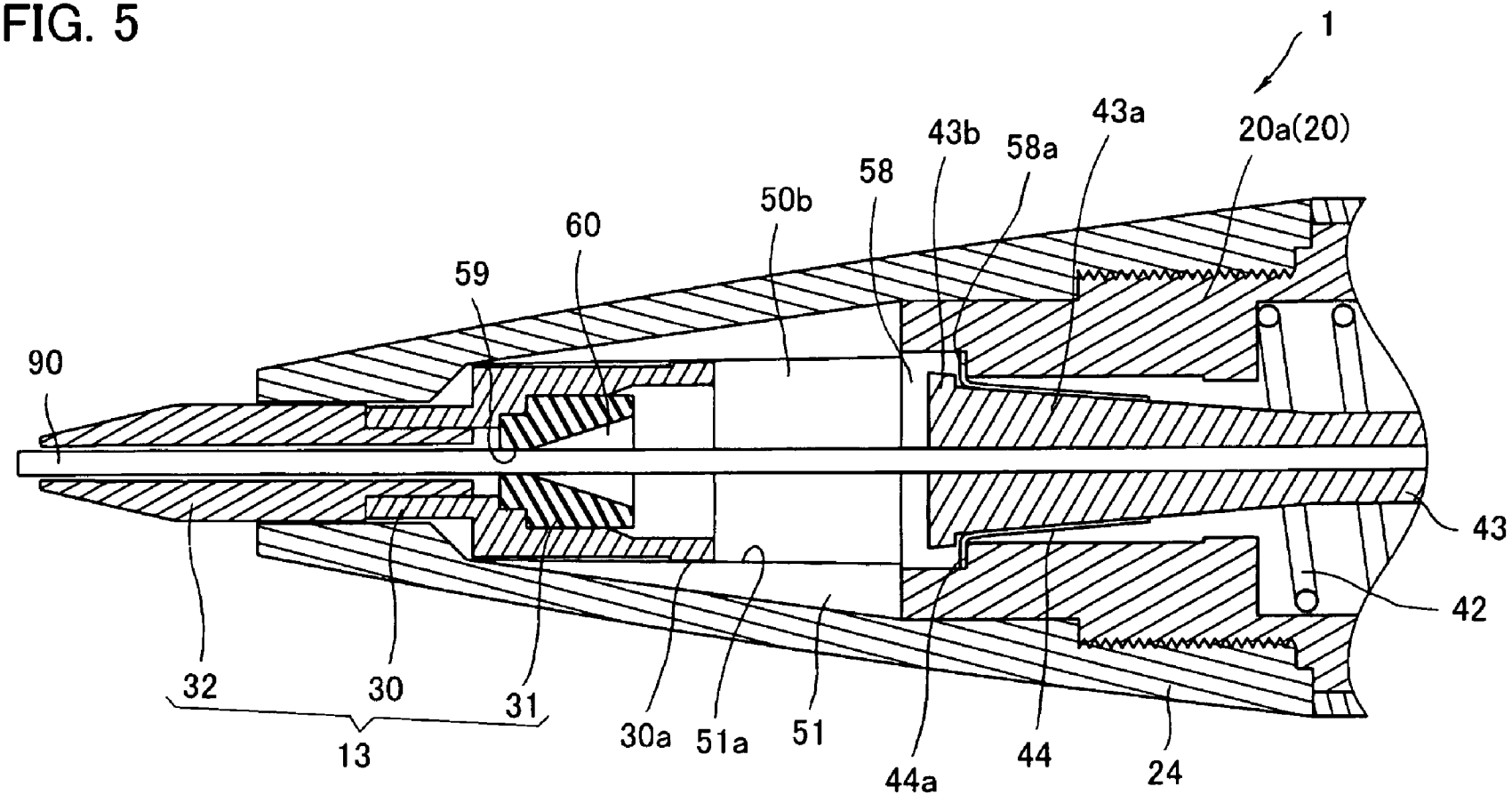
FIG. 5 is a partial cross section on an enlarged scale of the vicinity of the distal end of the mechanical pencil in FIG. 1.

As shown in FIG. 5, the front barrel 20*a* further has adjacent to its distal end a diameter-enlarged bore 58. The diameter-enlarged bore 58 is provided with a step 58*a* at its proximal end. The diameter-enlarged bore 58 arranges therein a protrusion 43*b* of a chuck 43 and a flange 44*a* of a chuck ring (a collar for fastening the chuck) 44, so that the protrusion 43*b* and the flange 44*a* are prevented from moving backward (toward the proximal end) of the step 58*a* even when the knocking member 45 is not pushed.

Figure 3:
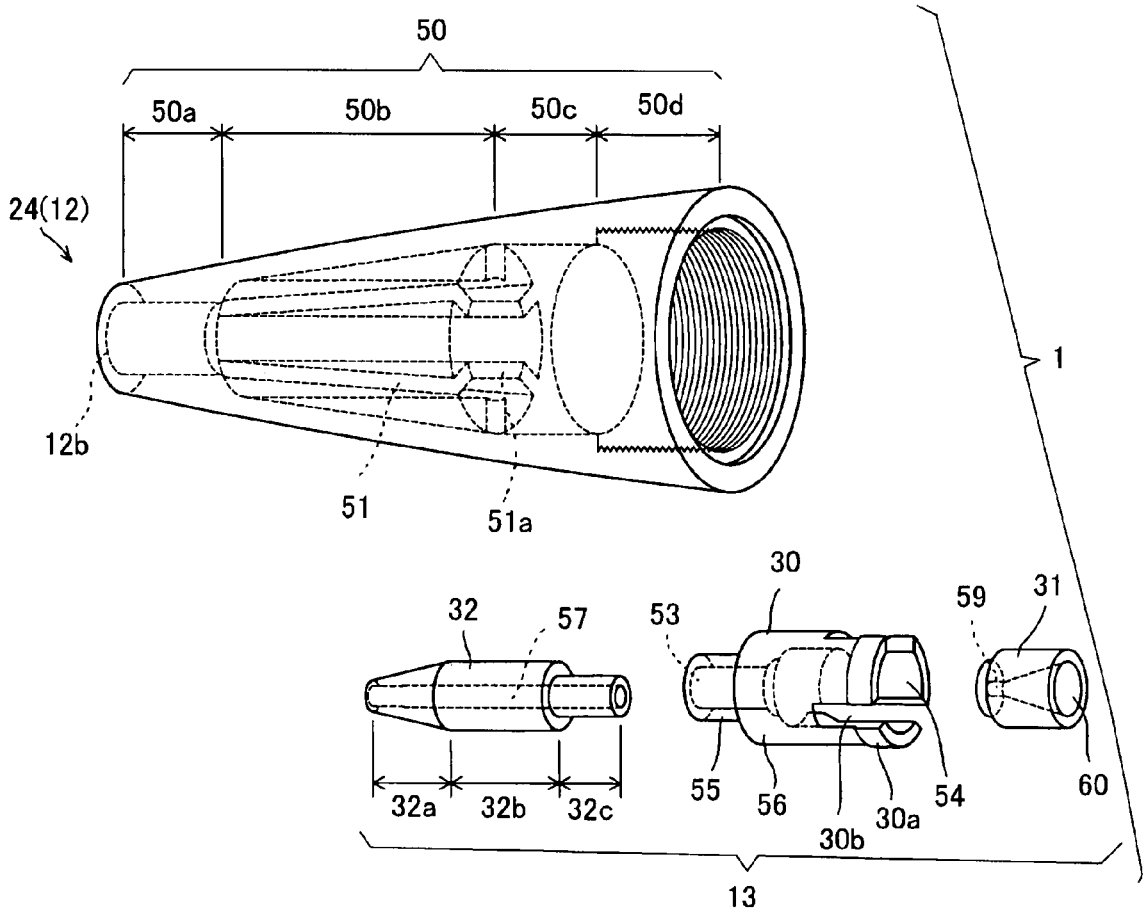
FIG. 3 is an exploded perspective view of an end cone and a slider.

The end cone 24 has a conical shape, and as shown in FIGS. 2 and 3, has therewithin a cavity 50, in which the slider 13 described below is placed.

The cavity 50 within the end cone 24 is divided into four portions: a distal portion 50*a* adjacent to an opening, a rib portion 50*b*, a front-barrel insertion portion 50*c*, and the threaded portion 50*d* in the order from a distal end of the cone 24.

The distal portion 50*a* is a substantially columnar cavity, having the opening 12*b* at its distal end. The distal portion 50*a* has an inner diameter substantially equal to an outer diameter of the lead guide 32 of the slider 13.

The rib portion 50*b* is, as shown in FIG. 3, a cavity with six ribs 51 protruding inward thereof. The ribs 51 have end faces 51*a* contacting with a protrusion 30*a* of a sliding main body 30.

The front-barrel insertion portion 50*c* is a substantially columnar cavity, into which a distal portion of the front barrel 20*a* is inserted. The threaded portion 50*d* is a female thread to be engaged with the threaded portion 25 of the front barrel 20*a* so as to fix the end cone 24 to the front barrel 20*a*.

The advancing mechanism 14 includes the inner barrel 40, a guiding tube 41, a biasing member 42, the chuck 43, the chuck ring (collar for fastening the chuck) 44, and the knocking member 45.

The inner barrel 40 has a tubular shape and is located within the outer barrel 20 of the main body 12. The inner barrel 40, in which leads 90 for use in the mechanical pencil 1 are stored, transmits force from the knocking member 45 on a knocking operation.

As shown in FIG. 1B, the inner barrel 40 further has the guiding tube 41 therewithin. The guiding tube 41 has a tubular shape and has a tapered opening at its proximal end such that its diameter increases toward the proximal end. The guiding tube 41 is located adjacent to a distal end of the inner barrel 40 and is adapted to supply a lead 90 within the inner barrel 40 to the chuck 43.

The biasing member 42 is specifically a coil spring and is adapted to bias the inner barrel 40 and the chuck 43 toward the proximal end thereof.

The knocking member 45 has a cap-like shape and is located at a proximal end of the outer barrel 20 and the inner barrel 40. The knocking member 45 is detachable and attached so that a shell 45*a* of the knocking member 45 is inserted into between the outer barrel 20 and the inner barrel 40, i.e., inside of the outer barrel 20 and outside of the inner barrel 40.

Herein, an eraser 92 of a columnar shape can be arranged within the knocking member 45. The eraser 92 is fitted into inside of the proximal end of the inner barrel 40. In this case, the eraser 92 is removed so as to supply additional leads 90.

The knocking member 45 is exposed outside when being attached. The knocking member 45, functioning as an operating part in the present embodiment, is pushed from its proximal end so as to advance the lead 90. The knocking member 45 is removed so as to supply leads 90 into the inner barrel 40.

The chuck 43 has therein a cavity adapted to pass the lead 90 therethrough and is provided with a chuck portion 43*a* adapted to hold the lead 90. As shown in FIG. 5, the chuck 43 is moved forward (toward the distal end) with holding the lead 90, thereby advancing the lead 90.

The chuck portion 43*a*, normally opening outward, makes a holding by means of the chuck ring 44. The chuck portion 43*a* has an outer periphery tapered with its diameter increasing toward its distal end in holding the lead 90, forming the protrusion 43*b* at the distal end.

The chuck ring 44 is a trumpet-shaped tube having a diameter increasing toward its distal end, having the flange 44*a* protruding outward at the distal end. The chuck ring 44 is located outside the chuck part 43*a* for holding the chuck part 43*a* from outside, releasing holding of the chuck part 43*a* when the chuck ring 44 is moved backward.

The protrusion 43*b* of the chuck part 43*a* prevents the chuck ring 44 from getting out toward the distal end. Further, the chuck ring 44 has the flange 44*a* having an outer width larger than an inner gap between the ribs 51, so as to get stuck on the ribs 51 and to be prevented from moving past toward the rib portion 50*b* of the end cone 24.

The front barrel 20*a* and the rear barrel 20*b* of the outer barrel 20, the clip 22, the end cone 24, and the knocking member 45 are made of resin plastic, having an appropriate stiffness so as to be undeformable in writing or advancing a lead. The grip 23 is made of a material having a high frictional resistance, thereby avoiding slipping in writing.

Figure 4:
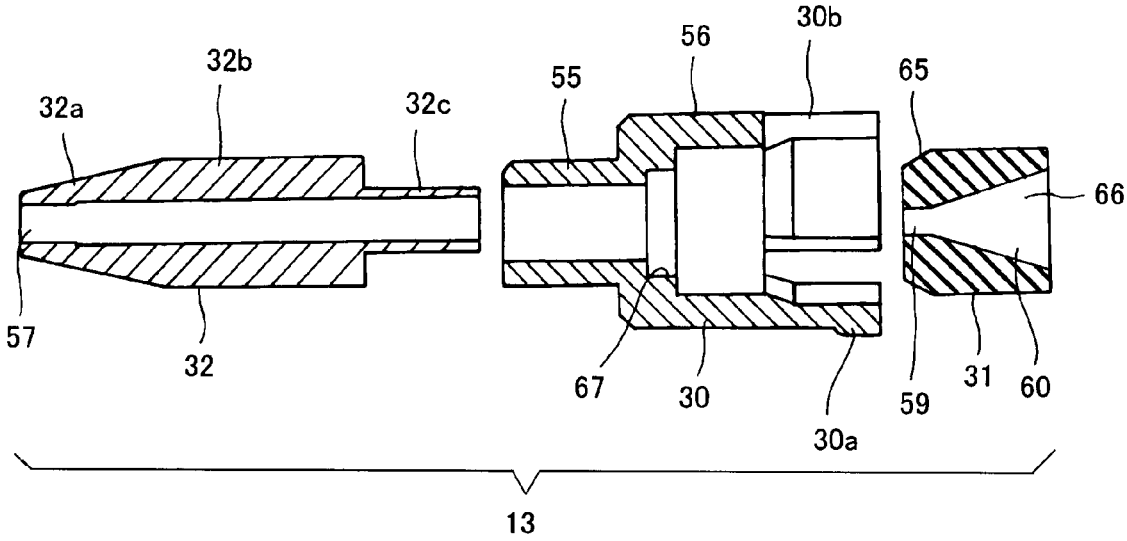
FIG. 4 is a cross section of the slider.

The slider 13, as shown in FIGS. 3 and 4, includes the sliding main body 30, a lead friction member 31, and the lead guide 32. The slider 13 defines therein a throughhole so as to pass the lead 90 therethrough. The slider 13 is located within the end cone 24, i.e., adjacent to a distal end of the mechanical pencil 1, being adapted to guide the lead 90 to the distal end by means of the lead guide 32 in using the pencil 1.

The sliding main body 30, as shown in FIGS. 3 and 4, has a tubular shape with a small diameter part 55 at its distal end and a large diameter part 56 at its proximal end. The large diameter part 56 includes the protrusion 30*a* with three slots 30*b*, the protrusion 30*a* protruding outward.

The sliding main body 30 defines a stepped throughhole extending in a length direction (direction from the distal end to the proximal end), with an opening 53 at its distal end and another opening 54 at its proximal end.

The small diameter part 55 has an outer diameter equal to or smaller than the inner diameter of the distal portion 50*a* of the end cone 24 and the large diameter part 56 has an outer diameter equal to or smaller than the inner gap of the ribs 51 of the rib parts 50*b* of the end cone 24, so that the sliding main body 30 is insertable into the end cone 24. Further, though an outer width of the protrusion 30*a* of the large diameter part 56 is larger than the inner gap of the ribs 51, the slots 30*b* allow the part 56 to be inwardly bent, so that an outer surface of the protrusion 30*a* is brought into contact with the end faces 51*a* of the ribs 51, with a proximal portion of the large diameter part 56 being inwardly bent, when the sliding main body 30 is inserted into the end cone 24.

The lead friction member 31 is inserted into the large diameter part 56. The large diameter part 56 has the step 67 therewithin, with which a tapered portion 65 on an outer side of the lead friction member 31 is brought into contact when the lead friction member 31 is inserted into the large diameter part 56, so that the tapered portion 65 is deformed within the throughhole.

The lead friction member 31 is of a tubular shape and defines a throughhole 66 therewithin. The lead friction member 31 has a columnar shape with the tapered portion 65 tapering toward its distal end, and has therewithin a small opening 59 at its distal end with a tapered portion 60 at its proximal end. The small opening 59 has an inner diameter equal to or slightly smaller than an outer diameter of the lead 90 to be used. The tapered portion 60 has a diameter increasing toward its proximal end.

The lead friction member 31 has an outer diameter at its proximal side equal to or slightly larger than an inner diameter of the large diameter part 56 of the sliding main body 30. The lead friction member 31 is inserted into the large diameter part 56 so that an outer surface of the lead friction member 31 has a close contact with an inner surface of the large diameter part 56, so as to be resistant to disengagement in using the mechanical pencil 1.

The lead friction member 31 is made of thermoplastic elastomer. A thermoplastic elastomer is generally a material consisting mainly of both a flexible component (soft segment) having rubber elasticity and a molecule restricting component (hard segment). The hard segment aggregates to form a domain, which expresses rubber elasticity similar to that of a crosslinked rubber around normal temperature, and which fuses at high temperature to be plastically deformed similarly to plastics, thereby freely flowing. Thus, the lead friction member 31 can be molded by plasticization as well as thermoplastic resin.

That reduces size variation in molding, in comparison with crosslinked rubber. Further, elasticity relatively stabilizes a friction between the lead friction member 31 and the lead 90.

Further, the lead friction member 31, which is made of thermoplastic elastomer, has such advantages as follows, in comparison with the use of crosslinked rubber.

Two-color molding (or coinjection molding) for the sliding main body 30 and the lead friction member 31 can be achieved, and in this case, the lead friction member 31 is certainly fixed to the sliding main body 30 and restrained from being detached. Further, the lead friction member 31 can be colored, having an attractive design. Still further, the lead friction member 31 can be molded with blending antibacterial agent thereinto, being sanitized.

Thermoplastic elastomer for use in the lead friction member 31 is selected from a styrene elastomer, an olefin elastomer, a urethane elastomer, an ester elastomer, and an amide elastomer, and especially a styrene elastomer and an olefin elastomer are preferable.

Specifically, Olefin Elastomer 3782 (JIS A hardness of 63) manufactured by Sumitomo Chemical Co., Ltd. or Styrene Elastomer T-436 (JIS A hardness of 70) manufactured by Asahi Chemical Industries Co., Ltd. can be used.

The lead guide 32, as shown in FIGS. 3 and 4, is of a tubular shape and divided into three parts: a tapered part 32*a*, a large diameter part 32*b*, and a small diameter part 32*c* in the order from its distal end. Further, the lead guide 32 has therewithin a throughhole 57 having an inner diameter slightly larger than the outer diameter of the lead 90.

The tapered part 32*a* tapers toward its distal end and has a truncated cone shape. The large diameter portion 32*b* has an outer diameter substantially equal to the diameter of the large diameter part 56 of the sliding main body 30, being movable within the distal portion 50*a* of the end cone 24. The small diameter part 32*c* has an outer diameter substantially equal to the inner diameter of the small diameter part 55 of the sliding main body 30, being insertable into the sliding main body 30 through the opening 53.

The sliding main body 30 in which the lead friction member 31 and the lead guide 32 are fitted (i.e., the slider 13) is put into the end cone 24. Further, the members including the inner barrel 40, the guiding tube 41, the biasing member 42, the chuck 43, and the chuck ring 44 are put into the outer barrel 20. Thereupon, the end cone 24 is fitted to the outer barrel 20, to which the knocking member 45 is attached, and whereby the mechanical pencil 1 is manufactured.

The above-mentioned members are arranged in the outer barrel 20, before having the front barrel 20*a* and the rear barrel 20*b* brought together. Thereafter, the front and the rear barrels 20*a* and 20*b* are integrally arranged.

The slider 13 arranged in the end cone 24 has friction with the end cone 24 at its outer surface and with the lead 90 at its inner surface when sliding. In the mechanical pencil 1 of the present embodiment, the protrusion 30*a* having friction with the end cone 24 works as an outer friction part, whereas the small opening 59 having friction with the lead 90 works as an inner friction part.

A frictional resistance between the lead 90 and the small opening 59 (inner friction part) where the lead friction member 31 contacts with the lead 90 is smaller than that between the ribs 51 and the protrusion 30*a* (outer friction part) where the main body 12 contacts with the slider 13.

As described above, the inner diameter of the small opening 59 is equal to or slightly smaller than the outer diameter of the lead 90. In the lead friction member 31 of the present embodiment, the small opening 59 has an inner diameter 0.05 mm smaller than the outer diameter of the lead 90. Specifically, in the case of a lead 90 having an outer diameter of 0.5 mm, the small opening 59 has an inner diameter of 0.45 mm, and in the case of a lead 90 having an outer diameter of 0.7 mm, the small opening 59 has an inner diameter of 0.65 mm. The small opening 59 of the lead friction member 31 of the present embodiment has a length of 0.5 mm.

The lead friction member 31 molded by thermoplastic elastomer and having the small opening 59 with the inner diameter smaller than the outer diameter of the lead 90 has high dimensional precision and elasticity, thereby ensuring friction with the lead 90 at the small opening 59 and keeping a frictional resistance with the lead 90 within a reasonable range.

Specifically, a slightly smaller diameter of the small opening 59 than the lead 90 ensures friction and increases a frictional resistance with the lead 90. Further, the use of thermoplastic elastomer, which is an elastic body, as a material of the lead friction member 31 stabilizes friction at the inner friction part even if the outer diameter of the lead 90 or the inner diameter of the small opening 59 varies slightly. Further, dimension variation in molding of thermoplastic elastomer is smaller than other materials such as rubber, so that friction is made more stable. Thereby, the mechanical pencil 1 adapted to allow a stable knocking operation is certainly manufactured.

Now, how to use the mechanical pencil 1 of the present embodiment 1 will be described below.

Figure 6:
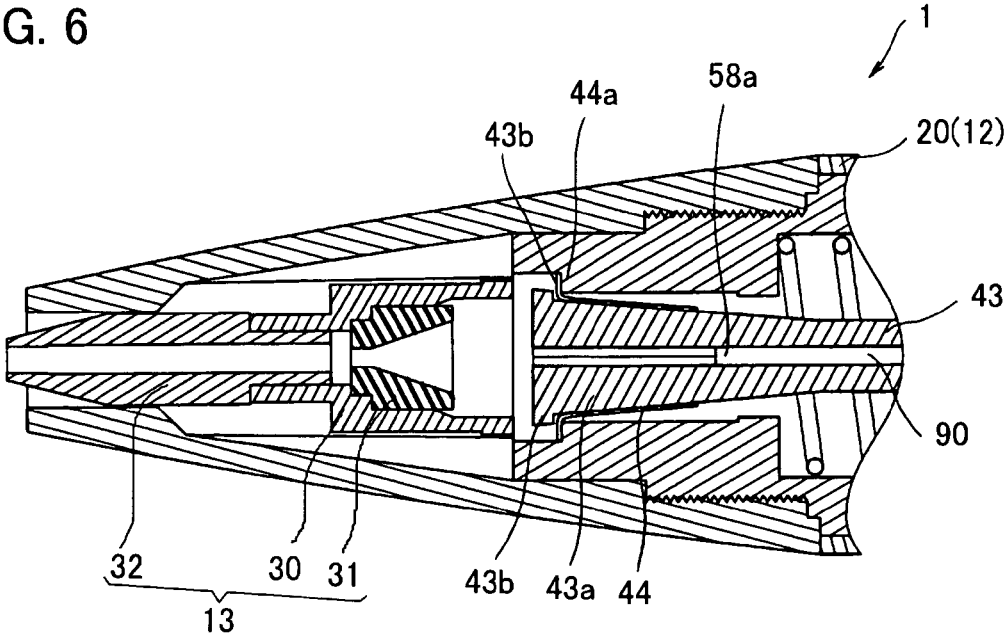
FIG. 6 is another partial cross section on an enlarged scale of the vicinity of the distal end of the mechanical pencil in FIG. 1.

First, the knocking member 45 is detached to fill the inner barrel 40 with a lead 90, and the knocking member 45 is attached again. When a distal side of the pencil 1 is made downward-facing, as shown in FIG. 6, the lead 90 passes through the guiding tube 41 and a tip 90*a* of the lead 90 comes just before the chuck portion 43*a* of the chuck 43.

Before pushing of the knocking member 45, the chuck 43 is biased toward its proximal end, but the flange 44*a* of the chuck ring 44 has contact with the step 58*a* of the front barrel 20*a*. Thus, the chuck ring 44 is located adjacent to a distal end of the chuck 43, so that the chuck portion 43*a* is in a holding condition. Therefore, the lead 90 is not advanced beyond the chuck portion 43*a*, being located at a proximal side of the chuck portion 43*a*.

Figure 7:
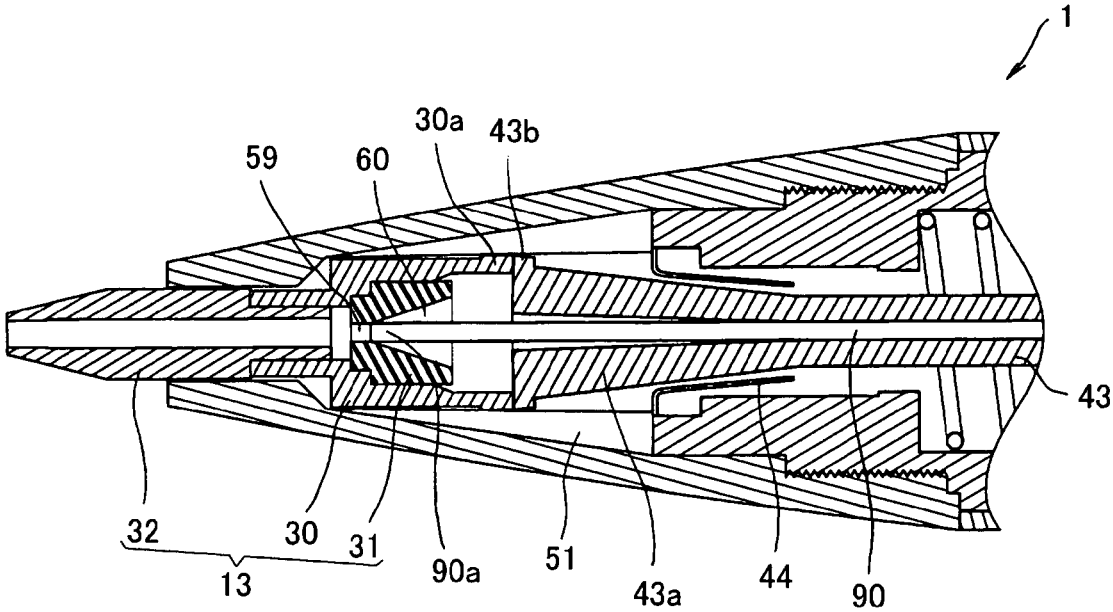
FIG. 7 is a further partial cross section on an enlarged scale of the vicinity of the distal end of the mechanical pencil in FIG. 1.

Pushing of the knocking member 45 toward the distal end advances the chuck 43 and the chuck ring 44 relative to the main body 12, but the flange 44*a* of the chuck ring 44 is stuck in the ribs 51 at a position during being advanced. Thereupon, as shown in FIG. 7, the chuck ring 44 comes to be located at a proximal side of the chuck 43, thereby allowing the chuck portion 43*a* to release the holding condition and to be placed in a releasing condition.

Then, the lead 90 is advanced toward the distal end due to gravity force and the tip 90*a* of the lead 90 is moved to a vicinity of the tapered portion 60 of the lead friction member 31 of the slider 13.

Further, the protrusion 43*b* located at the distal end of the chuck 43 pushes the proximal end of the sliding main body 30, so that the slider 13 is advanced with the chuck 43 being advanced.

Figure 8:
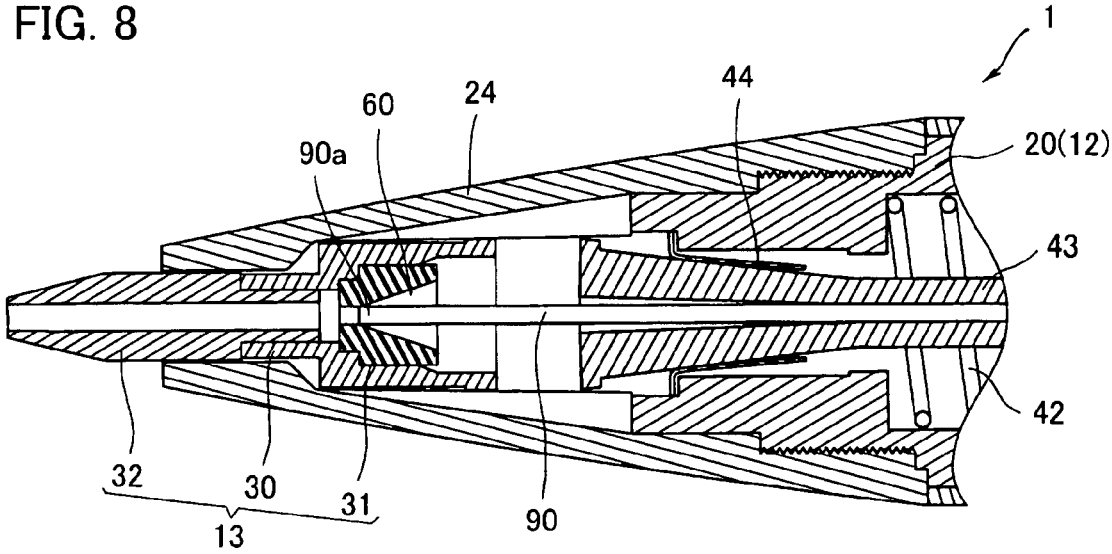
FIG. 8 is a further partial cross section on an enlarged scale of the vicinity of the distal end of the mechanical pencil in FIG. 1.

When the knocking member 45 is stopped being pushed, as shown in FIG. 8, the chuck 43 is retracted relative to the main body 12 due to a biasing force by the biasing member 42, and the chuck ring 44 is also retracted because of retraction of the chuck 43, so that the chuck 43 maintains its releasing condition.

Figure 9:
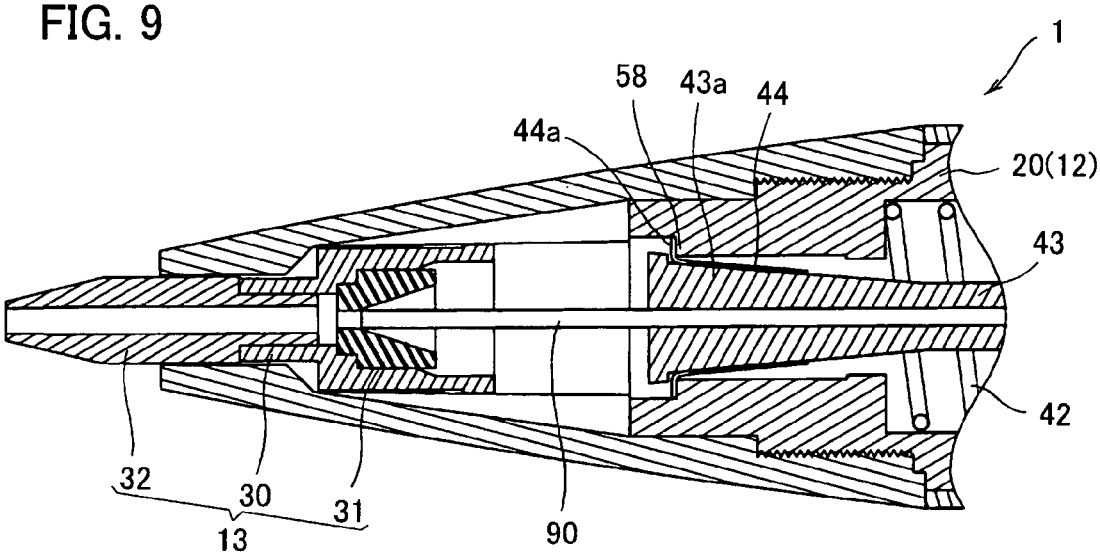
FIG. 9 is a further partial cross section on an enlarged scale of the vicinity of the distal end of the mechanical pencil in FIG. 1.

Further retraction of the chuck 43, as shown in FIG. 9, makes the flange 44*a* of the chuck ring 44 to be brought into contact with the step 58*a*, so that the chuck 43 and the chuck ring 44 revert to the previous condition before pushing of the knocking member 45. That is, the chuck ring 44 pinches the chuck portion 43*a* to revert in a holding condition. The holding condition starts just before completion of retraction, and whereby the lead 90 is slightly retracted.

Figure 10:
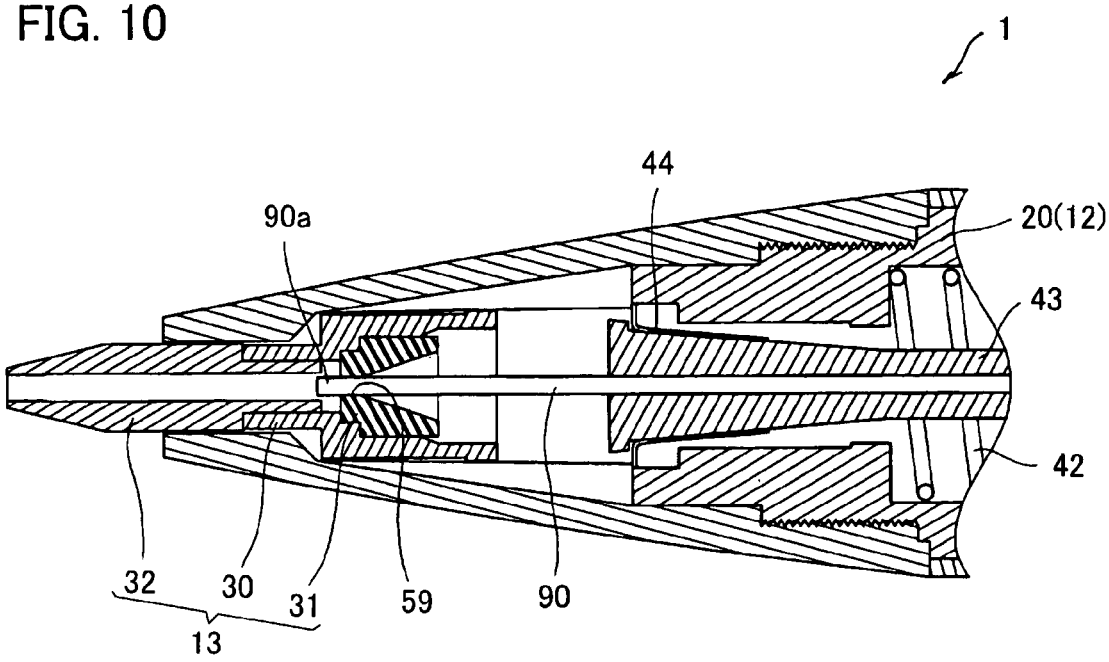
FIG. 10 is a further partial cross section on an enlarged scale of the vicinity of the distal end of the mechanical pencil in FIG. 1.
Figure 11:
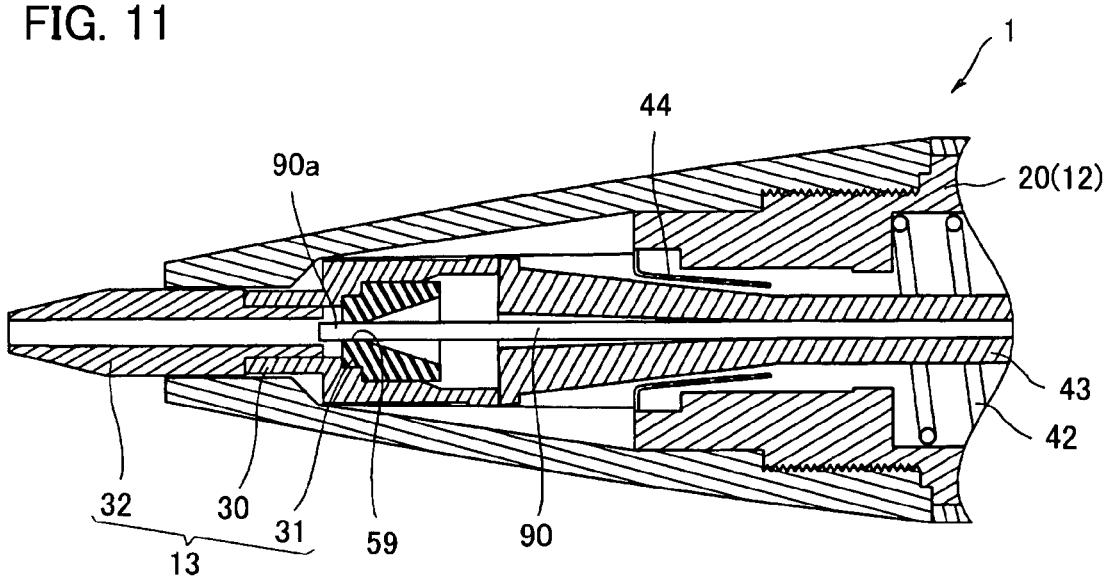
FIG. 11 is a further partial cross section on an enlarged scale of the vicinity of the distal end of the mechanical pencil in FIG. 1.

Another pushing of the knocking member 45 toward the distal end advances again the chuck 43, and as shown in FIG. 10, the lead 90 is advanced. Thereupon, the tip 90*a* of the lead 90 proceeds into the small opening 59. Further, the chuck 43 is advanced in a releasing condition, but the lead 90 is not advanced, so as to be in a state shown in FIG. 11.

When the knocking member 45 is stopped being pushed, the chuck 43 is retracted relative to the main body 12 due to the biasing force by the biasing member 42, but the lead 90 is not retracted because the chuck 43 maintains its releasing condition.

Figure 12:
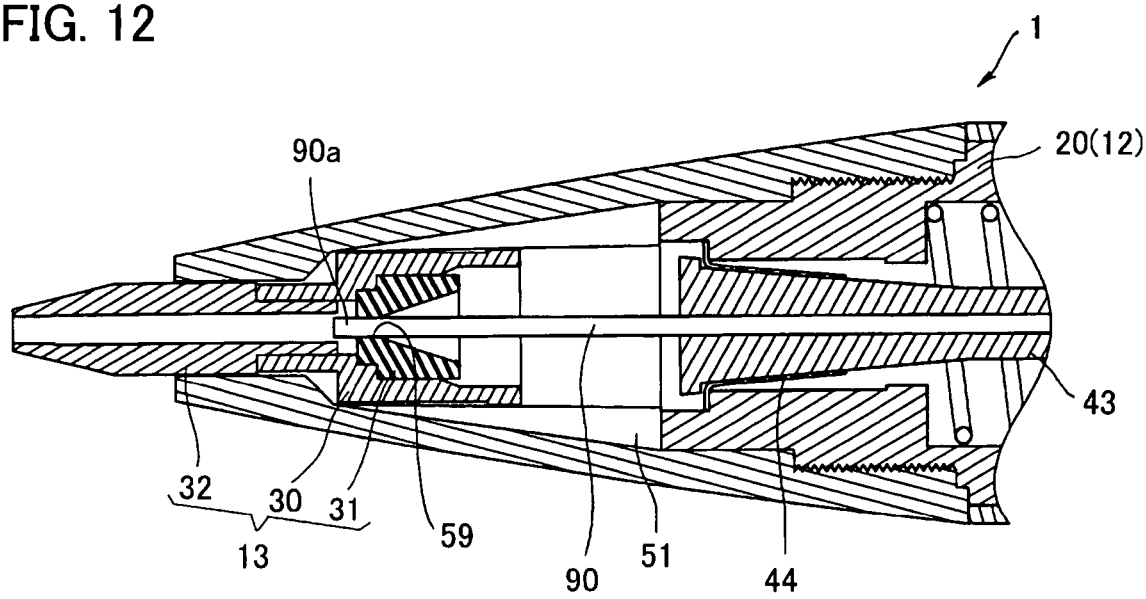
FIG. 12 is a further partial cross section on an enlarged scale of the vicinity of the distal end of the mechanical pencil in FIG. 1.

The chuck ring 44 is retracted by retraction of the chuck 43 (FIG. 12). During this retraction, maintenance of the releasing condition prevents the lead 90 from relative movement due to a frictional resistance with the small opening 59 (inner friction part), thereby maintaining the position of the lead 90 due to the frictional resistance between the small opening 59 and the lead 90.

The slider 13 is slidable relative to the main body 12, but a frictional resistance between the ribs 51 and the protrusion 30*a* (outer friction part), where the slider 13 has contact with the main body 12, is higher than a frictional resistance between the lead 90 and the small opening 59 (inner friction part), where the lead friction member 31 has contact with the lead 90, so that the slider 13 is prevented from being moved.

And then, the chuck 43 and the chuck ring 44 revert again to the previous condition before pushing of the knocking member 45.

In this way, one knocking operation in which the knocking member 45 is pushed toward the distal end and reverts to the previous condition advances the lead 90 by a length in which the chuck ring 44 is moved, i.e., a length similar to that in a length direction of the diameter-enlarged bore 58 of the front barrel 20*a*.

Users can advance the lead 90 of a necessary length to extrude the tip 90*a* of the lead 90, so as to use for writing.

During writing, the lead 90 is worn away and the tip 90*a* recedes. In this case, the lead guide 32 touches an object on which the writing is performed and the slider 13 is made retracted, thereby maintaining the tip 90*a* by an appropriate length.

After the use of the mechanical pencil 1, in the same manner as in ordinary ones, the knocking member 45 is pushed to force the slider 13 to be pressed onto the object, whereupon the knocking member 45 is stopped being pushed, so that the lead 90 and the slider 13 are put into the end cone 24.

As described above, the mechanical pencil 1 of the present embodiment uses the lead friction member 31 made of thermoplastic elastomer, thereby stabilizing a frictional resistance at the inner friction part. That enables an assured knocking operation, dispensing with a complicated structure.

The invention claimed is:

1. A mechanical pencil, comprising:

a main body of a tubular shape and having a length direction and a distal end and a proximal end in the length direction;

an advancing mechanism arranged within the main body; and a slider arranged within the main body, wherein the advancing mechanism comprises a chuck adapted to hold a lead, a collar for fastening the chuck and disposed outside of the chuck, and a biasing member for biasing the chuck toward the proximal end, the chuck being movable in the length direction by a knocking operation in such a manner as being moved forward to an advanced position by an external operation and moved backward to a retracted position by means of the biasing member on condition that the external operation is released with the chuck at the advanced position, the chuck being engaged with the collar so as to hold the lead on condition of being at the retracted position, and being disengaged from the collar so as to release the lead on condition of being at the advanced position, wherein the slider, comprising a lead guide and a lead friction member, is positioned at a distal side of the chuck so as to be movable in the length direction, the lead friction member being made of thermoplastic elastomer, and wherein the knocking operation renders the chuck to be advanced holding the lead so as to extend the lead to a predetermined position, to release the lead at the position, and to be retracted with maintaining the position of the lead by friction between the lead and the lead friction member, consequently advancing the lead to a distal end of the lead guide, wherein the slider is adapted to move in the length direction maintaining contact with the main body and has an outer friction part in contact with the main body and an inner friction part to be in contact with a lead, the inner friction part being formed on the lead friction member, and the inner and outer friction parts each having a frictional resistance so that the frictional resistance of the inner friction part is smaller than that of the outer friction part.

2. The mechanical pencil according to claim 1, wherein the slider further comprises a sliding main body of a tubular shape, into which the lead friction member is inserted.

3. The mechanical pencil according to claim 2, wherein the slider is adapted to move in the length direction maintaining contact with the main body and has an outer friction part in contact with the main body and an inner friction part to be in contact with a lead, the inner friction part being formed on the lead friction member, and the inner and the outer friction parts each having a frictional resistance so that the frictional resistance of the inner friction part is smaller than that of the outer friction part.

4. The mechanical pencil according to claim 3 being adapted to push and advance the slider by advancing the chuck.

5. The mechanical pencil according to claim 2 being adapted to push and advance the slider by advancing the chuck.

6. The mechanical pencil according to claim 2, the lead friction member having an inner diameter smaller than an outer diameter of a lead to be used.

7. The mechanical pencil according to claim 6, wherein the slider is adapted to move in the length direction maintaining contact with the main body and has an outer friction part in contact with the main body and an inner friction part to be in contact with a lead, the inner friction part being formed on the lead friction member, and the inner and the outer friction parts each having a frictional resistance so that the frictional resistance of the inner friction part is smaller than that of the outer friction part.

8. The mechanical pencil according to claim 7 being adapted to push and advance the slider by advancing the chuck.

9. The mechanical pencil according to claim 6 being adapted to push and advance the slider by advancing the chuck.

10. The mechanical pencil according to claim 1, the lead friction member having an inner diameter smaller than an outer diameter of a lead to be used.

11. The mechanical pencil according to claim 10 being adapted to push and advance the slider by advancing the chuck.

12. The mechanical pencil according to claim 10, wherein the slider is adapted to move in the length direction maintaining contact with the main body and has an outer friction part in contact with the main body and an inner friction part to be in contact with a lead, the inner friction part being formed on the lead friction member, and the inner and the outer friction parts each having a frictional resistance so that the frictional resistance of the inner friction part is smaller than that of the outer friction part.

13. The mechanical pencil according to claim 12 being adapted to push and advance the slider by advancing the chuck.

14. The mechanical pencil according to claim 1 being adapted to push and advance the slider by advancing the chuck.

15. The mechanical pencil according to claim 1 being adapted to push and advance the slider by advancing the chuck.

16. The mechanical pencil according to claim 1, wherein the slider further comprises a sliding main body having a tubular shape and proximal and distal ends, wherein the lead friction member has proximal and distal ends and an outer side on which a tapered portion is provided, the tapered portion tapering toward the distal end of the lead friction member, wherein the sliding main body defines a throughhole in a length direction between the proximal and distal ends of the sliding main body with an opening at the proximal end of the sliding main body, wherein the lead friction member is inserted in the opening of the proximal end of the sliding main body, wherein there is a step within the throughhole, wherein the tapered portion is brought into contact with the step and thereby deformed with the lead friction member directed into the throughhole through the opening at the proximal end of the sliding main body.

* * * * *